US005679307A

United States Patent [19]

Mantovan et al.

[11] Patent Number: 5,679,307

[45] Date of Patent: Oct. 21, 1997

[54] FACILITY FOR IN-LINE HEAT TREATMENT OF HOT-ROLLED PRODUCTS

[75] Inventors: Gianfranco Mantovan, Busto Arsizio; Ezio Colombo, Cassano Magnago, both of Italy

[73] Assignee: Pomini S.p.A., Varese, Italy

[21] Appl. No.: 685,662

[22] Filed: Jul. 24, 1996

[30] Foreign Application Priority Data

Jul. 27, 1995 [IT] Italy ..... MI95A1639

[51] Int. Cl.[6] ..... C21D 1/62

[52] U.S. Cl. ..... 266/132; 266/133

[58] Field of Search ..... 266/103, 130, 266/131, 132, 133; 198/219

[56] References Cited

U.S. PATENT DOCUMENTS

| | | | |
|---|---|---|---|
| 2,063,784 | 12/1936 | Bechtel et al. | 266/133 |
| 3,332,539 | 7/1967 | Buchheit | 198/219 |
| 3,340,109 | 9/1967 | Keough | 266/133 |
| 3,888,471 | 6/1975 | Coch | 266/133 |
| 4,486,246 | 12/1984 | Warchol | 148/18 |

FOREIGN PATENT DOCUMENTS

| | | |
|---|---|---|
| 2 133 268 | 11/1972 | France . |
| 823 885 | 12/1951 | Germany . |
| 1 804 932 | 10/1968 | Germany . |

OTHER PUBLICATIONS

Iron and Steel Engineer, pp. 39–44, Jan. 1991, Albert August; "Automatic On-Line Straightening, Cutting to Length and Stacking of Small and Medium Rolled Sections".

Patent Abstracts of Japan, vol. 7, No. 139, Jun. 17, 1983, JP-A-58 052442, Mar. 28, 1983.

Patent Abstracts of Japan, vol. 10, No. 120, May 6, 1986 and JP-A-60 245719, Dec. 5, 1985.

*Primary Examiner*—Scott Kastler

*Attorney, Agent, or Firm*—Oblon, Spivak, McClelland, Maier & Neustadt, P.C.

[57] ABSTRACT

A facility for in-line heat treatment of hot-rolled products, for example, long rods (16) includes: a tank (11) suitable for containing a refrigerating liquid medium (12), a plate (13) with stationary rakes (14) and mobile rakes (15) suitable for receiving the products (16) and transporting them through the tank (11) and outside of it on heat treatment performed, and closure lids (27) arranged above the plate (13).

7 Claims, 1 Drawing Sheet

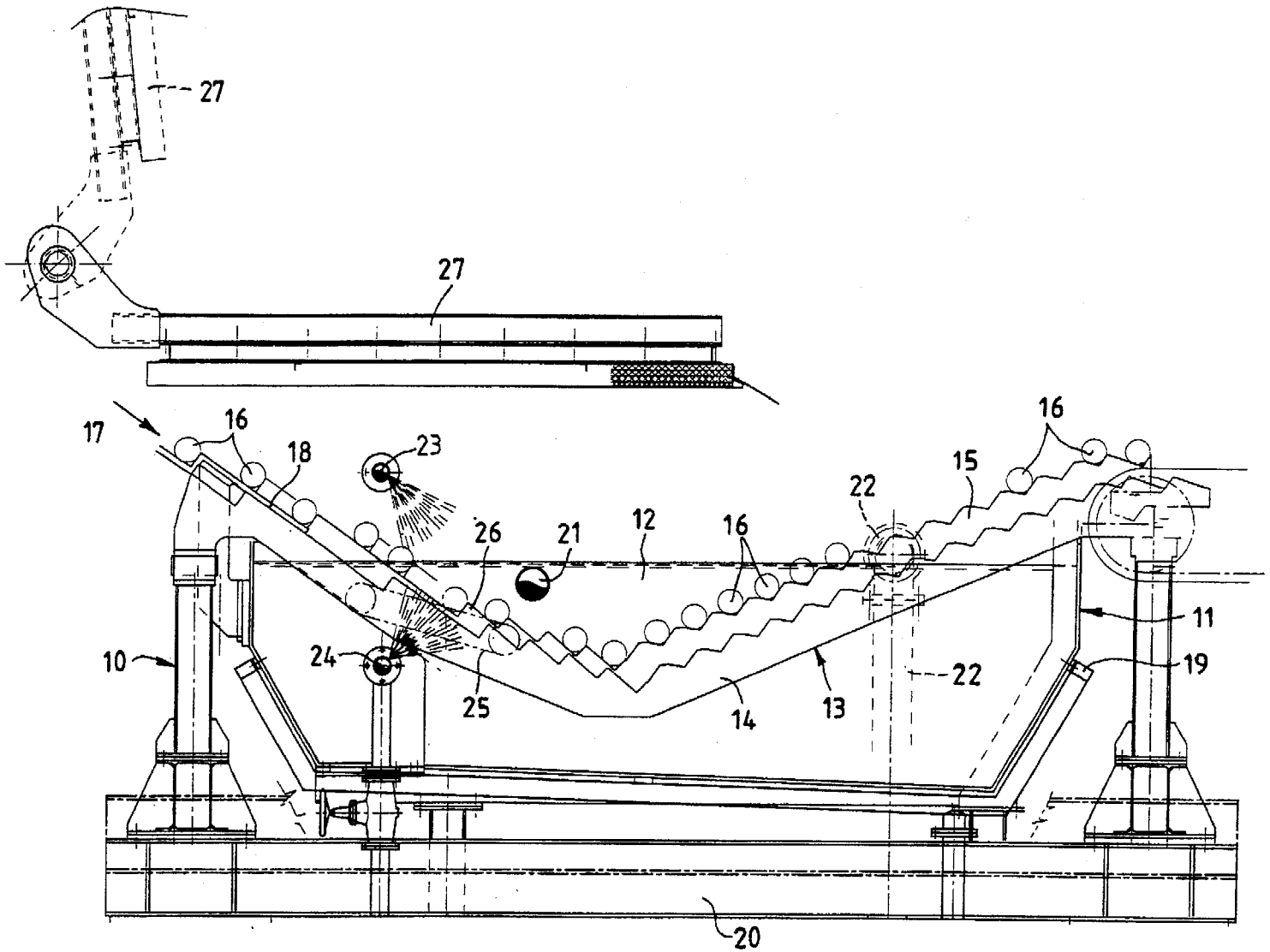
11
19
16
15
22
22
13
14
16
20
12
21
26
25
23
24
27
18
16
27
17
10

FACILITY FOR IN-LINE HEAT TREATMENT OF HOT-ROLLED PRODUCTS

BACKGROUND OF THE INVENTION

The present invention relates to an improved facility for in-line heat treatment of hot-rolled products, for example, long rods.

DESCRIPTION OF THE RELATED ART

Hot rolling products, like, e.g., long rods, had always been accompanied—since its origins—by problems of hot-rolled product cooling.

However, as those skilled in the art are very well aware of, during the past years, the means and concepts relating to hot-rolled product cooling have been developed so as to allow, during the rolling step, true in-line heat treatments to be carried out.

The advantage of performing the in-line heat treatment of the hot-rolled product is associated with the elimination, or reduction, of the necessary heating energy because the material is already at high temperatures during the process.

The desired result is to obtain through the in-line heat treatment, a product which displays higher mechanical characteristics and/or more suitable characteristics for a determined type of use of the finished material.

More recently conceived hot-rolling mills are characterized by high productivity rates, which anyway require a plurality of cooling steps provided downstream or along the rolling line.

At present, the cooling of the hot rolled product can be obtained according to either of the following ways: 1) by using cooling and/or heating means characterized by having large surface areas, as cooling plates or conveyor belt units installed downstream from the rolling mill; and 2) by using intensive cooling and/or heating means characterized by having small size, as, e.g., air cooling fans or water cooling pipes or induction cooling means (induction ovens), and by the type of coolant or heating medium used (air, water, air-water and so forth).

In view of the above, the metal hot-rolling technique aims at proposing more and more effective devices having the end purpose of obtaining, for a determined material type, the ideal temperature curve, so as to aim at producing, already in-line, the end product, or a temperature curve which at least facilitates the subsequent steps, both of processing and of off-line heat treatment, should such a requirement arise.

In particular, attempts in such direction were done by acting on the cooling plates, limited by to the possibility of delaying the cooling rate with lids, and, on the rolling mill, by using cooling pipes along the rolling line.

SUMMARY OF THE INVENTION

The general purpose of the invention is solving, or at least alleviating, the problems which affect the prior art, by applying the heat treatment technologies to a very wide range of materials, aiming at following ideal cooling curves according to the type of material and the diameter thereof.

The above said purpose is accomplished by an improved facility for in-line heat treating hot-rolled products, in particular, but not exclusively, long rods.

BRIEF DESCRIPTION OF THE DRAWINGS

The structural and functional characteristics of the invention and the advantages thereof over the prior art will be evident from the following disclosure, made by referring to the single schematic drawing appended which shows—in cross-sectional view—an example of heat treatment facility realized according to the teaching of the same invention.

DETAILED DESCRIPTION OF THE PREFERRED EMBODIMENTS

Referring to the appended figure, the facility for in-line heat treatment of hot-rolled products according to the present invention is generally indicated with (10) and is structurally formed by the combination of a tank (11) suitable for containing a treatment liquid medium (12), e.g., water, with a plate (13)—having a cradle configuration—which is partially dipped inside the liquid medium (12) contained in the tank (11).

The plate (13) can be of traditional type, comprising stationary rakes (14) with interposed mobile rakes (15) performing the task of causing the products (16), in the herein illustrated example long rods, coming from the hot rolling mill, to advance according to the direction of arrow (17), and fed along a staircase-like chute (18).

Such a feeding system is of a per se known type and consequently is not disclosed herein in greater detail.

Also the general structure of the cooling plate (13), which is of a known type for those skilled in the art, is not disclosed herein.

An example of cooling plate with stationary rakes with intervening mobile rakes is anyway illustrated in U.S. Pat. No. 3,332,539. The facility constituted by the combination of tank (11) and plate (13) is supported by a framework (20) which also supports pipings (21, 22), for treatment liquid medium (12) feed and drain, respectively.

Furthermore, orientatable nozzles (23) are provided outside of the tank, which are capable of a heat treatment liquid medium if and as so desired, as well as orientatable nozzles (24), inside the tank, capable of creating an agitation inside the treatment liquid medium (12).

With (19) a further drain duct for the treatment liquid medium is indicated, which is installed laterally to the tank (11).

With (25) a system of rotary chains is indicated, which acts on rods 16) and keeps them rotating at the end of the chute (18).

The facility disclosed hereinabove, realized according to the present invention, makes it possible the most suitable cooling type to be selected, and furthermore makes it possible—in particular in case of rapid cooling—different cooling rates to be accomplished by varying some system operating parameters (cooling water feed rate, water temperature, and so forth).

After having determined the most suitable operating parameters in order to obtain a predetermined in-line heat treatment, the operator will then be capable of securing the product quality.

The rods (16), coming from the roller conveyor of the rolling mill according to arrow (17) are delivered to the chute (18) and roll downwards until they reach the first tooth (26) of the plate (13).

It should be observed that along the chute (18), the rod (16), before reaching its end position, can be retained in various intermediate positions by means of stop means of known type, not shown in the drawing.

The possibility of stopping the product at intermediate points of the chute (18) has the purpose, above all for larger diameter products, of preventing the rod (16) from reaching excessively high speeds during its downwards sliding movement.

Furthermore, the purpose is also achieved of allowing the temperature to be determined, within certain limits, at which the heat treatment should be started inside the tank (11).

At the end of the chute (18), the rod (16) stops on the first tooth (26) of the plate (13), at a position in which it is dipped inside the tank (11), and in engagement with the chains (25) which keep it rolling, rendering the cooling uniform on it.

This feature is a particularly important one during the first step of rod cooling during which, owing to the considerable differences in temperature between the hot rod and the cooling liquid medium, situations can arise in which the cooling effect is different between the top and the bottom zones of said rod; such differences in cooling effect can be prevented precisely by keeping the rod rotating.

Through the plate (13), the rods (16) are caused to advance along the tank (11) inside which, as a function of the type of product and of the rolling speed, the material remains immersed inside the cooling liquid medium during a predetermined time.

In this regard, one should observe that from the tank (11) the cooling liquid medium can be discharged both longitudinally—through the drain 20 duct (22) and transversely—through the drain duct (19)—relatively to the rods dipped inside it.

Furthermore, the system for feeding the cooling liquid medium to the tank (11) is such as to secure that said liquid medium (e.g., water) will have, inside the tank, variable speed and temperature values, according to the needs.

Such a system can provide for the cooling liquid medium to be fed from top downwards, and to be drained from the bottom of the tank, so as to produce a forced circulation such as to prevent stagnation zones from establishing, or a feed from bottom upwards and a drain from top of tank, still for the same purpose.

As already said, the orientatable nozzles (24) perform the double purpose of delivering cooling liquid medium and keeping it agitated inside the tank (11).

As one will clearly see from FIG. 1, the inclined rakes of the plate (13) which perform the function of extracting the rods (16) from the tank (11) (i.e., the right-hand side portion looking at the drawing), have differently contoured teeth from the section of rakes designed to receive the rods (16) from the rolling mill roller conveyor (the left-hand side section, looking at the drawing).

Finally, the tank (11) can be closed at its upper portion by means of upper removable lids (27) which, should the operator wish to perform a slow cooling of the rolled products, will be lowered down (as shown in solid lines in the figure), above the first portion of the plate, so as to reduce the heat loss which, during this step, mainly takes place by an irradiation mechanism.

Of course, in this latter case, the tank (11) shall be empty, that is to say, no cooling liquid medium will be used.

The purpose recited in the preamble to the disclosure, of having available a facility for the in-line heat treatment of hot-rolled products in which all the necessary means for physically implementing a controlled cooling of the product are concentrated, is thus accomplished.

In particular, with the facility according to the present invention, the following three different treatment types can be carried out:

1) Rapid cooling

The rolled product, still hot, is immersed into the tank (11) filled with cooling liquid medium (e.g., water), so as to accomplish a high "speed cooling" (quenching). The lids (27) are lifted up.

2) Slow cooling

The rolled product, still hot, is deposited on the plate (13) while this is closed by the upper covering lids (27), which perform the purpose of slacking down the cooling of the rolled product. The tank (11) is empty.

3) Conventional cooling

The rolled product, still hot, is deposited on the plate in which it is air cooled without any covering, and, of course, with the tank (11) being empty.

In practice, by using the facility according to the present invention, the most suitable cooling type can be selected and it is furthermore possible, in particular in the case of fast cooling, the cooling speed to be regulated at different values by varying some system operating parameters (coolant water flow rate, water temperature, and so forth).

This means that once that the most suitable operating parameters in order to have a predetermined in-line heat treatment have been selected, the operator will be capable of securing the quality of the end product.

The purpose recited in the preamble to the disclosure is thus accomplished.

What is claimed is:

1. An apparatus for in-line heat treating hot rolled rods, comprising:

a tank for containing a cooling liquid;

means for continuously feeding cooling liquid to the tank so as to establish a forced circulation of cooling liquid therein;

means for agitating cooling liquid in the tank by feeding fluid jets to the tank; and a cradle having stationary and movable rakes, said cradle having, at one end thereof, an inclined chute portion located outside of said tank for receiving a rod, said cradle further having a mid portion located in said tank and another end located outside of said tank, wherein said stationary and movable rakes are operative to continuously and progressively transport a rod into and out of said tank along said cradle from said one end to said other end for heat treatment of the rod in said tank.

2. The apparatus of claim 1 wherein said agitating means comprise adjustable nozzles located inside and outside said tank.

3. The apparatus of claim 1 including means for rotating the rods on said cradle at a position where the rods are entering the tank.

4. The apparatus of claim 1 including a lid for said tank.

5. The apparatus of claim 1 wherein said tank contains water at 20° to 70° C. as said cooling liquid.

6. The apparatus of claim 2 wherein said fluid jets are water jets.

7. The apparatus of claim 2 wherein said fluid jets are air jets.

* * * * *